US011638487B2

(12) United States Patent
Frandrup

(10) Patent No.: US 11,638,487 B2
(45) Date of Patent: May 2, 2023

(54) RECESSED BED MOUNTABLE ARTICLE HOLDING SYSTEM

(71) Applicant: Luke Frandrup, Edina, MN (US)

(72) Inventor: Luke Frandrup, Edina, MN (US)

( * ) Notice: Subject to any disclaimer, the term of this patent is extended or adjusted under 35 U.S.C. 154(b) by 0 days.

(21) Appl. No.: 17/411,786

(22) Filed: Aug. 25, 2021

(65) Prior Publication Data

US 2023/0067411 A1 Mar. 2, 2023

(51) Int. Cl.

| | |
|---|---|
| ***A47C 19/02*** | (2006.01) |
| ***A47C 19/22*** | (2006.01) |
| ***A47B 96/02*** | (2006.01) |

(52) U.S. Cl.

CPC ..... *A47C 19/22* (2013.01); *A47B 96/02* (2013.01); *A47B 2220/0005* (2013.01)

(58) Field of Classification Search

CPC ..... A47C 19/22; A47C 19/00; A47C 19/02; A47C 21/00; A47C 21/02; A47C 21/003; A47B 2220/0005

See application file for complete search history.

(56) References Cited

U.S. PATENT DOCUMENTS

| | | | | |
|---|---|---|---|---|
| 4,691,396 | A | 9/1987 | Hoffman | |
| 4,831,673 | A | 5/1989 | Winckler | |
| 5,056,342 | A * | 10/1991 | Prinz | A47C 21/00 109/51 |
| 5,624,095 | A | 4/1997 | Zissu | |
| 5,732,914 | A | 3/1998 | Finn | |
| 6,073,899 | A | 6/2000 | Omrani | |
| 8,387,182 | B2 | 3/2013 | Edelman | |
| 10,016,063 | B2 | 7/2018 | San Martin | |
| 10,918,218 | B1 * | 2/2021 | Pieroth | F41C 33/041 |
| 2007/0211455 | A1 * | 9/2007 | Pieroth | F21V 21/088 362/157 |

* cited by examiner

*Primary Examiner* — Fredrick C Conley

(57) ABSTRACT

A recessed bed mountable article holding system includes a frame engagement member for engaging a bedframe. A receiver is attached to and extends downwardly from the frame engagement member. The receiver is attached to the frame engagement member such that the frame engagement member extends inwardly away from a vertical plane of an exterior surface of the bedframe and under a mattress supported by the bedframe. The receiver releasably holds a self-defense apparatus.

17 Claims, 4 Drawing Sheets

RECESSED BED MOUNTABLE ARTICLE HOLDING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bed mountable shelving device and more particularly pertains to a new bed mountable shelving device that allows a person to store a self-defense weapon or article under a bed in an easily accessible manner. Moreover, the defense weapon will be stored in such a manner that it is recessed under the bed so that the defense weapon, and the storage means itself, is not easily observable to others while facilitating easy access to the defense weapon.

(2) Description of Related Art Including Information Disclosed Under 37 CFR 1.97 and 1.98

The prior art relates to bed mountable shelving devices that typically extend downwardly or outwardly directly from the edge of the bed so that items such as remote controls, food plates, books and the like can be reached by a person sitting in a bed.

BRIEF SUMMARY OF THE INVENTION

An embodiment of the disclosure meets the needs presented above by generally comprising a frame engagement member for engaging a bedframe. A receiver is attached to and extends downwardly from the frame engagement member. The receiver is attached to the frame engagement member such that the receiver is positioned inwardly away from a vertical plane of an exterior surface of the bedframe and under a mattress supported by the bedframe. The receiver releasably holds a self-defense apparatus.

In another embodiment, the disclosure teaches a method of hiding a self-defense apparatus under a bed in an easily accessible location. The method includes extending a frame engagement member between a bedframe and a bedding member positioned on the bedframe to suspend a receiver attached to the frame engagement member from the bedframe such that the receiver is spaced inwardly away from a vertical plane of an exterior surface of the bedframe to position the receiver under a mattress supported by the bedframe. Positioning the self-defense apparatus on the receiver.

In yet another embodiment, the method includes the steps of extending a frame engagement member between a bedframe and a bedding member positioned on the bedframe to suspend a receiver attached to the frame engagement member from the bedframe such that the receiver is spaced inwardly away from a vertical plane of an exterior surface of the bedframe to position the receiver under a mattress supported by the bedframe. The receiver includes an inner wall extending downwardly from the frame engagement member. A lip is attached to a lower edge of the vertical wall and extends toward the vertical plane. The lip is angled upwardly and the self-defense apparatus is positioned on the lip.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
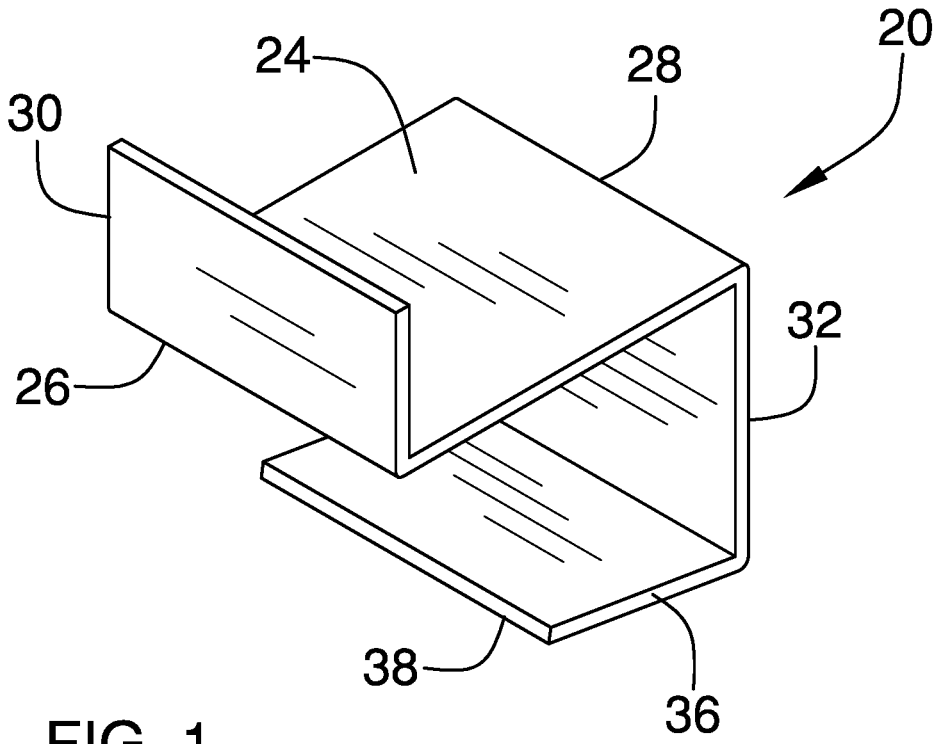
FIG. 1 is a front isometric view of a recessed bed mountable article holding system according to an embodiment of the disclosure.
Figure 2:
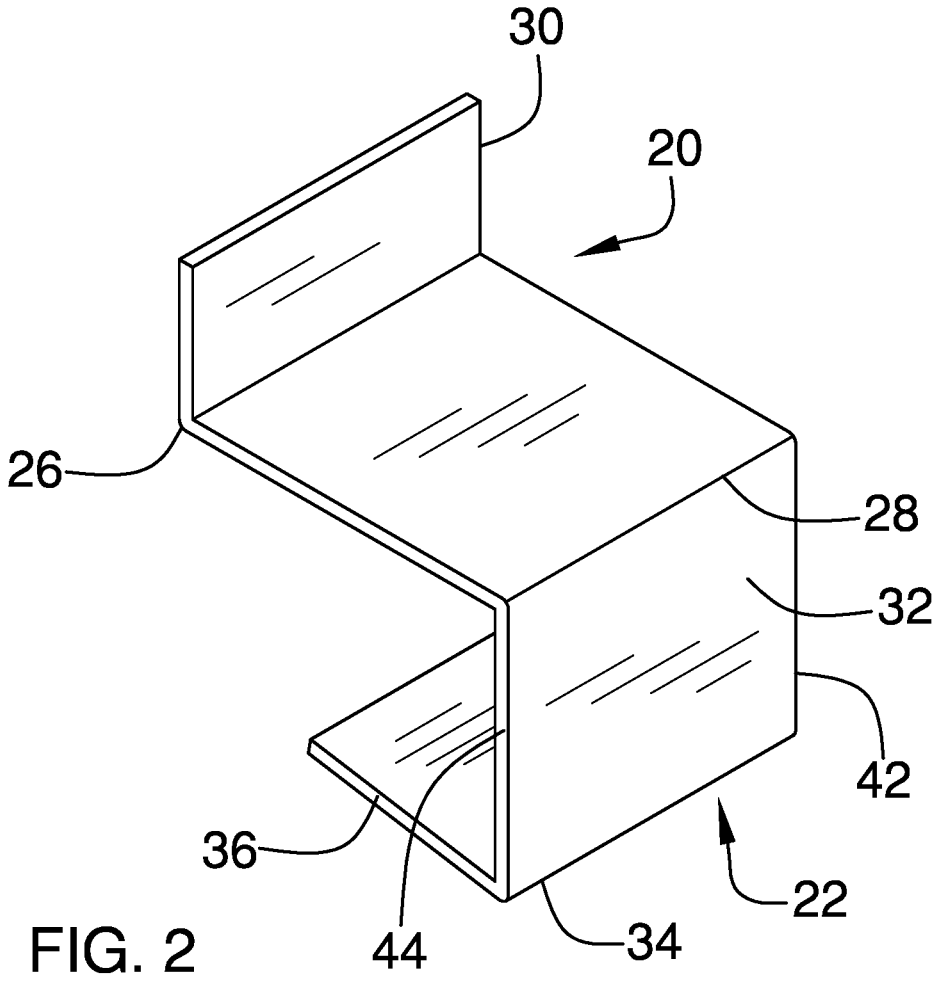
FIG. 2 is a rear isometric view of an embodiment of the disclosure.

With reference now to the drawings, and in particular to FIGS. 1 through 5 thereof, a new bed mountable shelving device embodying the principles and concepts of an embodiment of the disclosure and generally designated by the reference numeral 10 will be described.

Figure 3:
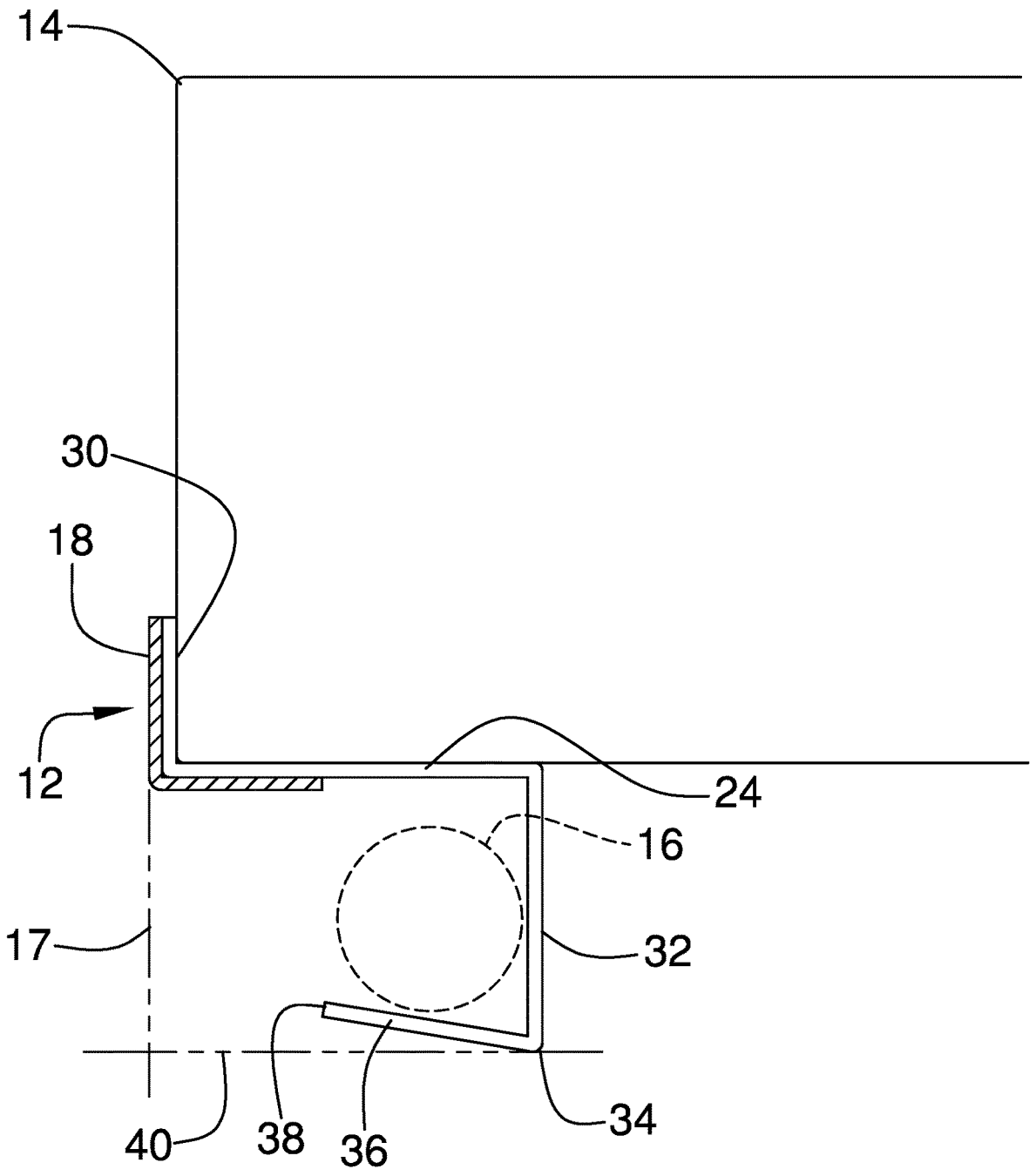
FIG. 3 is a side in-use view of an embodiment of the disclosure.
Figure 4:
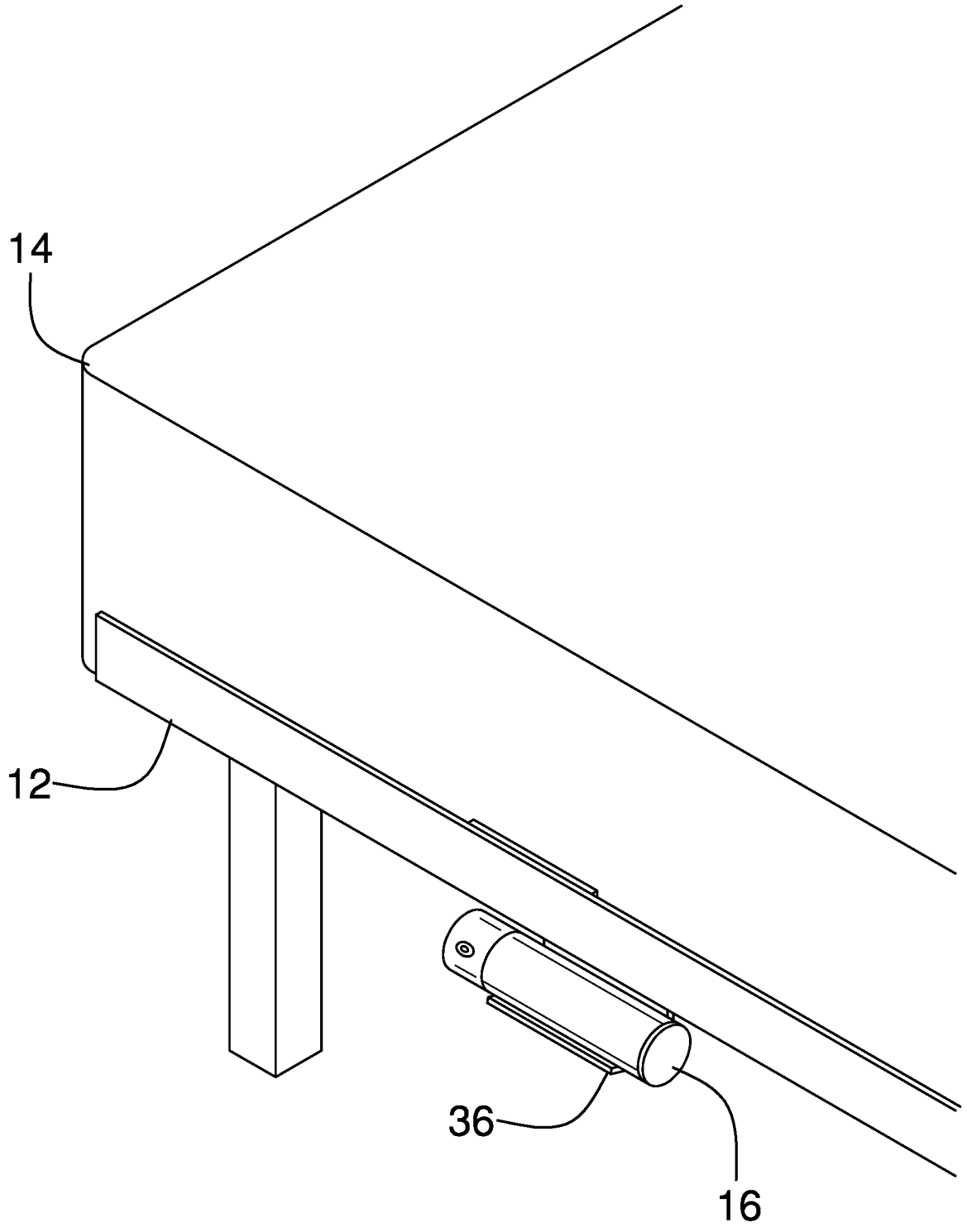
FIG. 4 is a front isometric in-use view of an embodiment of the disclosure.
Figure 5:
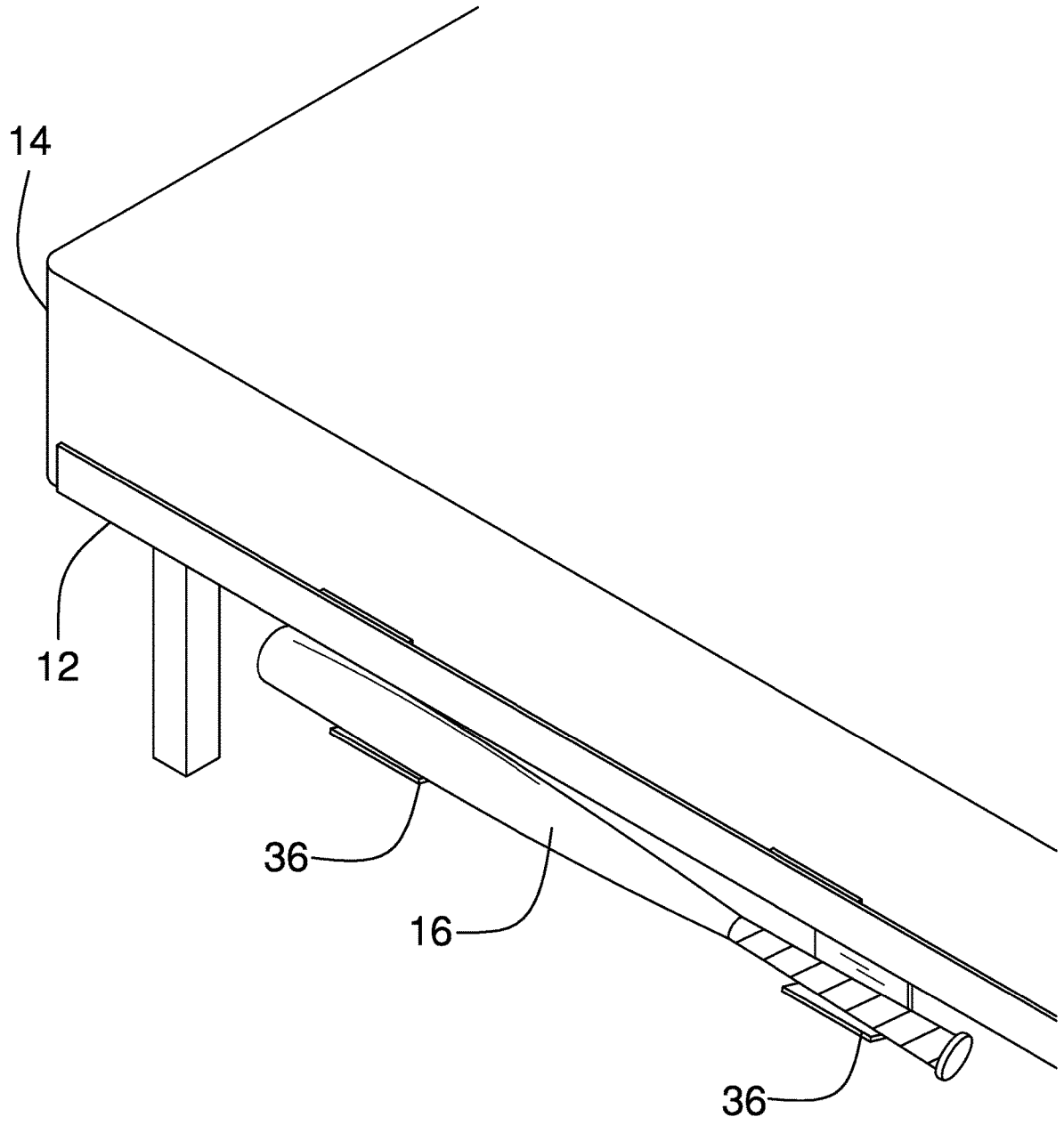
FIG. 5 is a front isometric in-use view of an embodiment of the disclosure.

As best illustrated in FIGS. 1 through 5, the recessed bed mountable article holding system 10 generally comprises a frame engagement member 20 configured to engage a bedframe 12 of a conventional bed. It should be understood that the term "bedframe" is being used in its generic sense a conventional structure that supports a mattress 14 with or without a box spring. Moreover, when using the terms mattress or box spring herein each is considered interchangeable with each other. The bedframe 12 may include structures having an L-shaped cross shape as is shown in FIG. 3, though the bedframe 12 may instead comprise a platform bedframe wherein a plurality of slats extends between two supports to directly support a mattress without requiring a box spring.

A frame engagement member 20 is configured to engage the bedframe 12. A receiver 22 is attached to and extends downwardly from the frame engagement member 20. The receiver 22 is attached to the frame engagement member 20 such that the receiver 22 is positioned inwardly away from a vertical plane 17 of an exterior surface 18 of the bedframe 12 and under a mattress 14 supported by the bedframe 12. The exterior surface 18 is defined as the outermost lateral side of the bedframe 12 as shown in FIG. 3. The receiver 22 is configured to releasably hold a self-defense apparatus 16 as will be further explained below.

The frame engagement member 20 comprises an upper plate 24 having an outer edge 26 and inner edge 28. The upper plate 24 is positionable between the bedframe 12 and the mattress 14 positioned on the bedframe 12 such that the inner edge 28 is directed under an area covered by the mattress 14. The vertical plane 17 extends adjacently along and downwardly from the outer edge 26. The upper plate 24 has a depth from the outer edge 26 to the inner edge 28 between 3.0 inches and 10.0 inches. The upper plate 24 is planar from the outer edge 26 to the inner edge 28.

The frame engagement member 22 may further include a vertical plate 30 that is attached to the outer edge 26 and extends upwardly therefrom. The vertical plate 30 extends along the outer edge 16 and forms a perpendicular angle with the upper plate 24 to typically extend upwardly form the upper plate 24 a distance of at least 0.5 inches. As is readily apparent from FIG. 3, the vertical plate 30 is positioned between the bedframe 12 and the mattress 14 in a vertical orientation to prevent the upper plate 24 from sliding outwardly from between frame 12 and the mattress 14.

The receiver 22 has an open side facing a direction outwardly away from the area covered by the mattress 14. This allows a person to easily retrieve an article 16 being held by the receiver 22. The receiver 22 is spaced away from the vertical plane 17 a distance equal to at least 0.5 inches. This positions the receiver 22 under a bed sufficiently such that the receiver 22 is less conspicuous to a casual observer.

The receiver 22 includes an inner wall 32 that is attached to the inner edge 28 and extends downwardly therefrom. The inner wall 32 has a bottom edge 34 positioned opposite of the inner edge 28. The inner wall 32 extends downwardly from the upper plate 24 a distance of less than 6.0 inches. The inner wall 32 may be planar and be oriented parallel to the vertical plane 17. A lip 36 is attached to the bottom edge 34 of the inner wall 32 and extends toward the vertical plane 17. The lip 36 has a distal edge 38 relative to the inner wall 32 wherein the distal edge 38 is positioned above a horizontal plane 40 intersecting the bottom edge 34 of the inner wall 32. This prevents articles from sliding or rolling off the lip 36. The lip 36 may be planar and form an acute angle with the inner wall 32. The acute angle is most often between 70° and 88°. It should be understood that the inner wall 32 and lip 36, while shown as each being planar, may comprise a curved shape or the inner wall 32 may be angled from the upper plate 24 toward the vertical plane 17. Therefore J-shaped and semi-circular shapes are also contemplated. The shape employed may be tailored to specific articles, though a planar lip 36 and inner wall 32 may be preferred for ease of construction and to ensure that retrieval of the article 16 is not impeded by the shape of the receiver 22. Additionally contemplated is an upwardly extending ridge, not shown, extending along the distal edge 38 to further retain objects on the lip 36.

The receiver 22 may be provided in differing sizes depending upon the article 16 to be supported by the receiver 22. The receiver 22 has a first lateral edge 42 and a second lateral edge 44. The receiver 22 will typically have a width from the first lateral edge 42 to the second lateral edge 44 between 0.50 inches and 8.0 inches. The receiver 22 and frame engagement member 20 may be a unitary structure as shown in the Figures and comprising a single unbroken piece of material. Alternatively, the receiver 22, the frame engagement member 20 and components thereof may include releasably detachable elements structurally held together with conventional mechanical fasteners, clips, mating members and the like. Materials used for the system 10 will most often include plastics and metals, though any material having sufficient rigidity to support the weight of a selected article 16 may be utilized. Thus, carbon composites, wood, elastomers, glass and the like may also be used. The materials may be colored any color which may assist in the receiver 20 blending into its surroundings.

In use, frame engagement member is positioned on an interior edge 16 of the bedframe 12 as shown in the Figures such that mattress 14 is positioned on the frame engagement member 20 to retain it place. This positions the receiver 22 under the mattress 14 in a recessed position relative to the bedframe 12 so that the receiver 22 is not easily noticeable by casual observance. The receiver 22 may then be used for holding a self-defense article 16 such as a can of pressurized pepper spray, electroshock weapons (i.e. TASERs), and combinations thereof. While knives and guns may also be placed on the receiver, it is noted that the purpose of the system 10 is to conceal the self-defense article 16 in such a way that it is not noticed by others but also in a manner that the self-defense article is not secured or locked and therefore weapons dangerous to children would most often not be held by the receiver 22. It is also noted that a pair of systems 10 may be used together to hold an elongated object that are utilized as self-defense articles 18 such as a bat or shotgun. Where an elongated object such as a bat is being held by a pair of receivers 22, the receivers 22 may have a smaller width down to 0.5 inches. Should an intruder break into a person's dwelling, the self-defense article 18 will be readily accessible without providing any indication to the intruder that such the self-defense article 18 is accessible. It should be understood that non-self-defense articles may be positioned on the receiver 22 such as flashlights, remote controls, and the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bed mountable support assembly configured to retain a self-defense apparatus in a recessed condition relative to a bedframe, the assembly comprising:

a frame engagement member configured to engage the bedframe;

a receiver being attached to and extending downwardly from the frame engagement member, wherein the receiver is attached to the frame engagement member such that the receiver is positioned inwardly away from a vertical plane of an exterior surface of the bedframe and under a mattress supported by the bedframe, the receiver being configured to releasably hold the self-defense apparatus; and wherein the frame engagement member comprises an upper plate having an outer edge and inner edge, the upper plate being configured to be positionable on a bedframe and under a mattress positioned on the bedframe such that the upper plate is horizontal and the inner edge is directed under an area covered by the mattress, the vertical plane extending adjacently along and downwardly from the outer edge, and a vertical plate being attached to the outer edge and extending upwardly therefrom, the vertical plate extending along the outer edge, the vertical plate forming a perpendicular angle with the upper plate wherein the vertical plate is configured for being positioned between the bedframe and an outer wall of the mattress such that the frame engagement member is contoured to be obscured from view by the bedframe.

2. The bed mountable support assembly according to claim 1, wherein the frame engagement member further comprises a vertical plate being attached to the outer edge and extending upwardly therefrom.

3. The bed mountable support assembly according to claim 1, wherein the upper plate has a depth from the outer edge to the inner edge between 3.0 inches and 10.0 inches.

4. The bed mountable support assembly according to claim 1, wherein the upper plate is planar from the outer edge to the inner edge.

5. The bed mountable support assembly according to claim 4, wherein the frame engagement member further comprises the vertical plate extending upwardly form the upper plate a distance of at least 0.5 inches.

6. The bed mountable support assembly according to claim 5, wherein the receiver includes:

an inner wall being attached to the inner edge and extending downwardly therefrom, the inner wall having a bottom edge positioned opposite of the inner edge, the inner wall extending downwardly from the upper plate a distance of less than 6.0 inches, the inner wall being planar and being oriented parallel to the vertical plane; and a lip being attached to the bottom edge of the inner wall and extending toward the vertical plane, the lip having a distal edge relative to the inner wall, the distal edge being positioned above a horizontal plane intersecting the bottom edge of the inner wall, the lip being planar and forming an acute angle with the inner wall, the acute angle being between 70° and 88°.

7. The bed mountable support assembly according to claim 6, wherein the receiver has a first lateral edge and a second lateral edge, the receiver having a width from the first lateral edge to the second lateral edge between 0.50 inches and 8.0 inches.

8. The bed mountable support assembly according to claim 6, wherein the acute angle is between 70° and 88°.

9. The bed mountable support assembly according to claim 5, wherein the receiver includes:

an inner wall being attached to the inner edge and extending downwardly therefrom, the inner wall having a bottom edge positioned opposite of the inner edge; and a lip being attached to the bottom edge of the inner wall and extending toward the vertical plane, the lip having a distal edge relative to the inner wall, the distal edge being positioned above a horizontal plane intersecting the bottom edge of the inner wall.

10. The bed mountable support assembly according to claim 1, wherein the receiver has an open side facing a direction outwardly away from the area covered by the mattress.

11. The bed mountable support assembly according to claim 10, wherein the receiver is spaced away from the vertical plane a distance equal to at least 0.5 inches.

12. The bed mountable support assembly according to claim 1, wherein the receiver includes:

an inner wall being attached to the inner edge and extending downwardly therefrom, the inner wall having a bottom edge positioned opposite of the inner edge; and a lip being attached to the bottom edge of the inner wall and extending toward the vertical plane, the lip having a distal edge relative to the inner wall, the distal edge being positioned above a horizontal plane intersecting the bottom edge of the inner watt.

13. The bed mountable support assembly according to claim 12, wherein the inner wall extends downwardly from the upper plate a distance of less than 6.0 inches.

14. The bed mountable support assembly according to claim 13, wherein the inner wall is planar and is oriented parallel to the vertical plane.

15. The bed mountable support assembly according to claim 14, wherein the lip is planar and forms an acute angle with the inner wall.

16. A method of hiding a self-defense apparatus under a bed in an easily accessible location, the method including the steps of:

extending a frame engagement member between a bedframe and a bedding member positioned on the bedframe such that the frame engagement member is obscured from being viewed by the bedframe and to suspend a receiver attached to the frame engagement member from the bedframe such that the receiver is spaced inwardly away from a vertical plane of an exterior surface of the bedframe to position the receiver under a mattress supported by the bedframe, the receiver including an inner wall extending downwardly from the frame engagement member, a lip being attached to a lower edge of the vertical wall and extending toward the vertical plane, the lip being angled upwardly; and positioning the self-defense apparatus on the lip.

17. A method of hiding a self-defense apparatus under a bed in an easily accessible location, the method including the steps of:

extending a frame engagement member between a bedframe and a bedding member positioned on the bedframe such that the frame engagement member is obscured from being viewed by the bedframe and to suspend a receiver attached to the frame engagement member from the bedframe such that the receiver is spaced inwardly away from a vertical plane of an exterior surface of the bedframe to position the receiver under a mattress supported by the bedframe; and positioning the self-defense apparatus on the receiver.

* * * * *